US006417455B1

(12) United States Patent
Zein et al.

(10) Patent No.: US 6,417,455 B1
(45) **Date of Patent: *Jul. 9, 2002**

(54) CONDUCTIVE FOIL

(75) Inventors: Walter Zein, Metzingen; Ralf Schmid, Kaltental; Martin Frey, Lichtenstein, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/533,686

(22) Filed: Mar. 23, 2000

(30) Foreign Application Priority Data

Apr. 1, 1999 (DE) ..... 199 14 907

(51) Int. Cl.[7] ..... H01B 7/08
(52) U.S. Cl. ..... 174/117 F
(58) Field of Search ..... 174/117 F, 117 FF, 174/250, 251

(56) References Cited

U.S. PATENT DOCUMENTS 4,832,621 A * 5/1989 Asai et al. ..... 174/117 FF X
4,931,598 A * 6/1990 Calhoun et al. ..... 174/117 F
5,342,997 A * 8/1994 Kanno et al. ..... 174/117 FF

FOREIGN PATENT DOCUMENTS

| | | |
|---|---|---|
| DE | 11 00 810 | 3/1961 |
| DE | 24 41 665 | 3/1979 |
| DE | 90 11 268.7 | 10/1991 |
| DE | 196 28 850 | 1/1997 |
| DE | 179 19 238 | 10/1998 |
| EP | 0 305 058 | 3/1989 |
| WO | WO 98/18138 | 4/1998 |

* cited by examiner

*Primary Examiner*—Chau N. Nguyen
(74) *Attorney, Agent, or Firm*—Kenyon & Kenyon

(57) ABSTRACT

In a conductive foil, for the conductive connection of electrical/electronic components, the foil including an elastically malleable, non-conductive carrier foil strip on which a plurality of printed circuit traces are arranged, insulated to the outside and running next to each other in the longitudinal direction of the carrier foil strip, in order to ensure that the conductive foil can be bent in a lasting two- or three-dimensional shape. The conductive foil is provided with at least one lastingly malleable shaping element that is insulated from the printed circuit traces and that runs in the longitudinal direction of the carrier foil strip.

9 Claims, 2 Drawing Sheets

CONDUCTIVE FOIL

BACKGROUND INFORMATION

Conductive foils made of an elastically malleable, non-conductive carrier foil strip having printed circuit traces that are insulated to the outside and that run in the longitudinal direction of the carrier foil strip are used, for example, in motor vehicles to connect various electrical/electronic components to each other. The conductive foils are composed of a carrier foil made of, for example, polyamide, onto which are applied thin printed circuit traces of copper, which are covered by an insulating material, for example a further insulating foil or an insulating enamel. At the ends of the strip-shaped conductive foil, contacting devices can be arranged which are often configured as soldering eyelets and are soldered to connector pins of electrical or electronic components. Conductive foils of this type are known, for example, from German Patent No. 197 19 238. The conductive foils are elastically malleable and thus are relatively insensitive to vibration and stress due to shaking.

However, it is disadvantageous that the known conductive foils are flaccid, so that it is not possible to give the conductive foils a lasting two-dimensional or three-dimensional shape by manual or machine bending. This disadvantage makes it more difficult to install the conductive foil in electrical apparatuses, since the flaccid conductive foil must continuously be held steady during assembly, and fasteners are potentially necessary to secure the conductive foil on the housing walls or support framework in electrical apparatuses.

SUMMARY OF THE INVENTION

As a result of the conductive foil according to the present invention, these disadvantages are avoided. The conductive foil advantageously has at least one lastingly malleable shaping element, extending in the longitudinal direction of the carrier foil strip and applied to the carrier foil strip of the conductive foil so as to be insulated from the printed circuit traces. The shaping element can be arranged on the carrier foil in a simple and economical manner, and it advantageously makes it possible to give the conductive foil a lasting two- or three-dimensional shape. By "lasting" in this context, it is understood that the two- or three-dimensional shape of the conductive foil does not change by itself during transport or assembly but can be changed by a fresh manual or machine bending of the shaping element. It is particularly advantageous that as a result of the flexural stiffness of the conductive foil resulting from the shaping element, manual or machine processing of the conductive foil is dramatically simplified. The known manufacturing process of conductive foils, advantageously, needs to be changed only slightly. Since the shaping element runs in the longitudinal direction of the carrier foil strip in the same direction as the printed circuit traces, the conductive foil can be advantageously unrolled in the longitudinal direction. Then, as needed, pieces of various lengths can be cut from the roll and processed further. In the unrolling and rolling up, it is true, a certain resistance must be overcome resulting from the fact that the shaping element is curled up or stretched out, but in view of the advantages described above, this is entirely acceptable.

It is particularly simple to manufacture the at least one shaping element out of metal. For example, the shaping element can be a single metal wire running in the longitudinal direction of the carrier foil strip, the metal wire being introduced as an insertion part in the conductive foil or being bonded to the carrier foil strip, making the manufacturing of the conductive foil only somewhat more expensive. The metal wire can be made of very inexpensive material, raising the manufacturing costs of the conductive foil only slightly. As a result of a manual or machine bending of the metal wire arranged in the conductive foil, the conductive foil, in a very simple manner, can be given a lasting shape and the installation of the conductive foil, for example in the apparatus housing of an electronic control unit, can be made significantly easier. Two metal wires running in the longitudinal direction of the carrier foil strip can advantageously be arranged on the conductive foil. As a result, it is particularly easy to give the conductive foil a three-dimensional shape.

The shaping element, however, can also be a metal foil applied to the carrier foil strip, the metal foil having sufficient thickness to make possible a lasting malleablility of the conductive foil.

DETAILED DESCRIPTION

Figure 1:
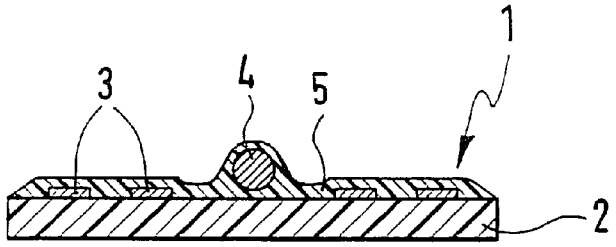
FIG. 1 shows a cross-section of a first exemplary embodiment of a conductive foil according to the present invention.
Figure 2:
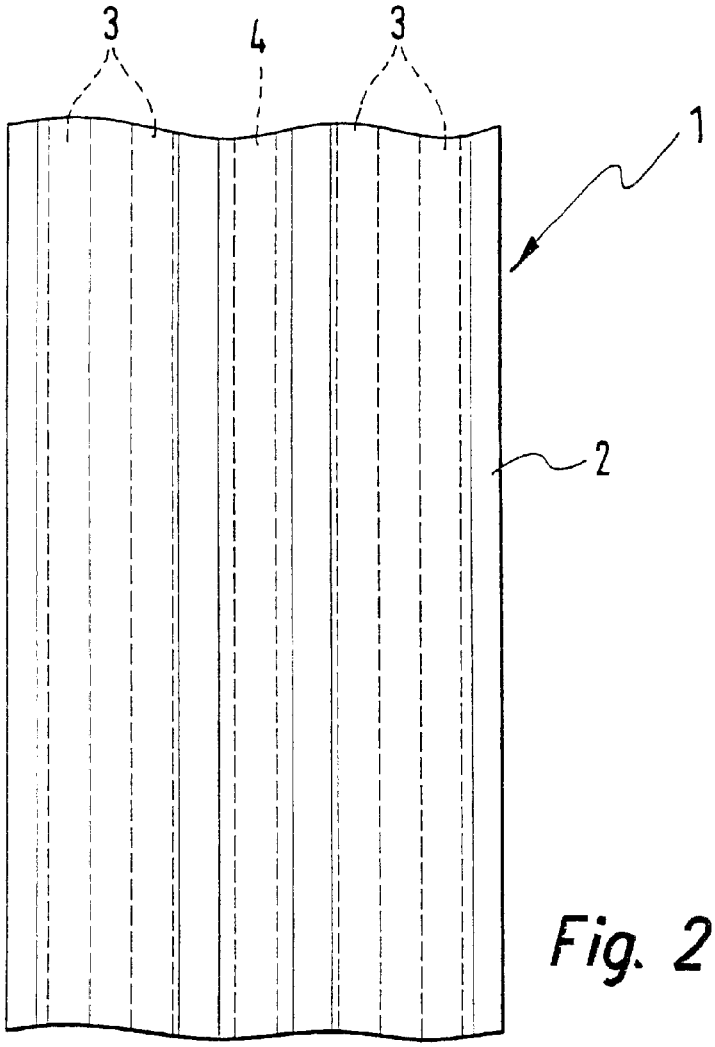
FIG. 2 shows a top view of the conductive foil of FIG. 1.

In FIG. 1 and FIG. 2, a first exemplary embodiment of the conductive foil according to the present invention is depicted. Conductive foil 1 includes a carrier foil strip 2 made of an electrically insulating and elastically malleable material, such as polyamide.

On carrier foil strip 2, printed circuit traces 3 are laid down running essentially parallel with respect to each other in the longitudinal direction of carrier foil strip 2. Printed circuit traces 3, in a generally known manner, are made of copper having a thickness of, for example, 40 $\mu$m or less. In this context, copper that is patterned in a photo process is first deposited on the carrier foil strip, and is subsequently strengthened using electroplating. The thinner the copper patterns are, the more economically the conductive foil can be manufactured. As can be seen additionally in FIG. 1, printed circuit traces 3 are insulated to the outside using a protective coating or an insulating layer 5 applied onto carrier foil strip 2. For example, this can be a further insulating foil, an appropriate covering layer, or an insulating spray. In FIG. 2, a top view of a segment of carrier foil strip 2 from FIG. 1 is depicted. Next to printed circuit traces 3, a shaping element 4 running parallel to the printed circuit traces in the longitudinal direction of the carrier foil strip is applied to carrier foil strip 2, the shaping element in this exemplary embodiment being configured as a metal wire having a circular cross-section and running in the center of the conductive foil. Metal wire 4 is insulated from printed circuit traces 3 by insulating layer 5 and can be, for example, an inexpensive copper wire having a diameter of 1 mm. The diameter of the metal wire should be at least large enough so that a lasting shaping of conductive foil 1 can be realized by bending the wire. However, other materials and configurations of shaping element 4 are also conceivable. Since the at least one shaping element 4, in contrast to printed circuit traces 3, does not have to be designed as an electrical conductor, it is, for example, also possible to make shaping element 4 out of an elastically malleable plastic.

Figure 7:
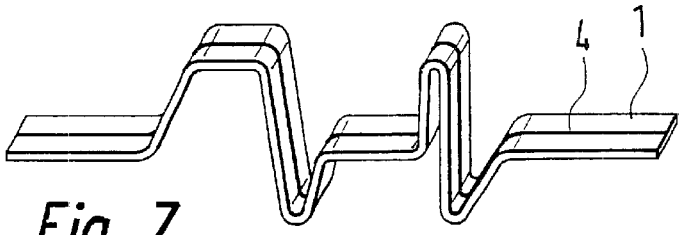
FIG. 7 shows a perspective view of a conductive foil according to the present invention that is bent into a two-dimensional shape.

FIG. 7 depicts conductive foil 1 from FIG. 1 after conductive foil 1 has been bent into a desired two-dimensional shape. This shape, for example, can be fitted to a given housing contour of an electrical device. As a result of metal wire 4, conductive foil 1 retains this shape lastingly, making it easier to install conductive foil 1 in the electrical device in difficult-to-access locations. The ends of conductive foil 1 in FIG. 7 can be provided with soldering eyelets or other undepicted contacting means.

Figure 3:
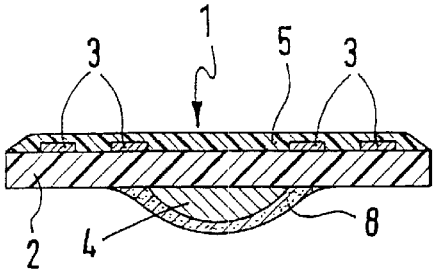
FIG. 3 shows a second exemplary embodiment of the conductive foil according to the present invention.

In FIG. 3, a further exemplary embodiment of conductive foil 1 according to the present invention is depicted. In contrast to FIG. 1, the shaping element here is mounted, using an adhesive 8, onto the carrier foil strip on the side of carrier foil strip 2 that is opposite printed circuit traces 3. Shaping element 4 here has a roughly semi-circular cross-section.

Figure 4:
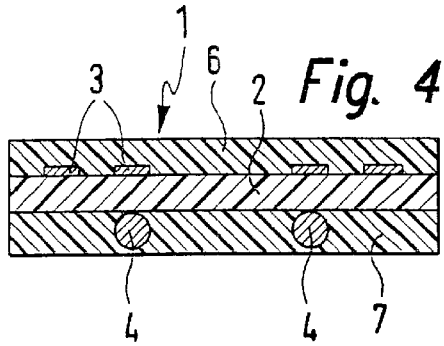
FIG. 4 shows a third exemplary embodiment of the conductive foil according to the present invention.
Figure 8:
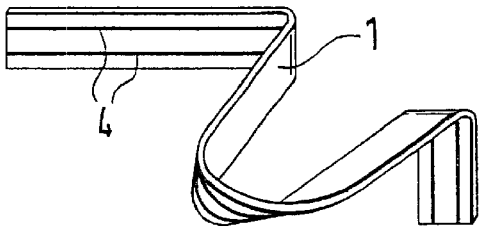
FIG. 8 shows a perspective view of a conductive foil according to the present invention that is bent into a three-dimensional shape.

In FIG. 4, an exemplary embodiment is depicted in which printed circuit traces 3 on the upper side of carrier foil strip 2 are insulated to the outside by a further polyamide layer 6. On the lower side of carrier foil strip 2, two metal wires 4, at a distance from each other, are arranged so as to pass through an elastically malleable further insulating layer 7, which also can be configured as a polyamide layer. As a result of two metal wires 4, a three-dimensional shaping of conductive foil 1 is made particularly easier, as is depicted, by way of example, in FIG. 8.

Figure 5:
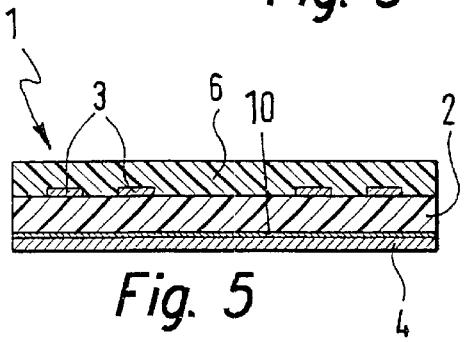
FIG. 5 shows a fourth exemplary embodiment of the conductive foil according to the present invention.

In FIG. 5, an exemplary embodiment is shown in which shaping element 4 is designed as a metal layer 4 having a thickness of 100 $\mu$m, that is applied to the lower side of carrier foil strip 2 over an adhesive layer 10. Due to metal layer 4, plastic malleablility of conductive foil 2 is achieved in two axes running perpendicular to each other in the plane of carrier foil 2.

Figure 6:
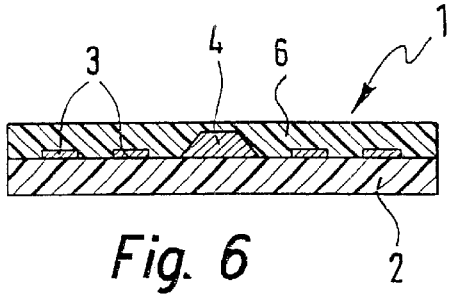
FIG. 6 shows a fifth exemplary embodiment of the conductive foil according to the present invention.

FIG. 6 depicts a further exemplary embodiment, in which shaping element 4 is arranged on the upper side of carrier foil strip 2 next to printed circuit traces 3 and is covered by an insulating polyamide layer 6. Shaping element 4, extending in the longitudinal direction of carrier foil strip 2 in this exemplary embodiment, has a trapezoidal cross-section.

In addition, further configurations and arrangements are possible, the shaping element, as depicted in FIG. 1, being either embedded completely in an insulating material or, as in FIG. 5, not being covered with insulating material on one side.

What is claimed is:

1. A conductive foil for conductively connecting electrical components, comprising:

an elastically malleable, non-conductive carrier foil strip;

a plurality of printed circuit traces situated on the carrier foil strip, the printed circuit traces being insulated to an outside and running next to each other in a longitudinal direction of the carrier foil strip; and at least one malleable, lasting shaping element electrically insulated from the printed circuit traces, the shaping element running in the longitudinal direction of the carrier foil strip.

2. The conductive foil according to claim 1, wherein the shaping element is composed of metal.

3. The conductive foil according to claim 1, wherein the shaping element includes a single metal wire running in the longitudinal direction of the carrier foil strip.

4. The conductive foil according to claim 1, wherein the shaping element includes two metal wires running parallel to each other in the longitudinal direction of the carrier foil strip.

5. The conductive foil according to claim 1, wherein the shaping element includes a metal foil applied to the carrier foil strip.

6. The conductive foil according to claim 1, wherein the shaping element is bonded to the carrier foil strip.

7. The conductive foil according to claim 1, wherein the shaping element is bent so that the conductive foil has a two-dimensional structure.

8. The conductive foil according to claim 1, wherein the shaping element is bent so that the conductive foil has a three-dimensional structure.

9. The conductive foil according to claim 1, wherein the at least one malleable, lasting shaping element provides the conductive foil, upon bending, one of a lasting two-dimensional shape and a lasting three-dimensional shape.

* * * * *